United States Patent [19]

Smith

[11] 4,048,682

[45] Sept. 20, 1977

[54] BED PAN

[76] Inventor: Pattie Smith, 252 Highwood Ave., Ridgewood, N.J. 07410

[21] Appl. No.: 732,007

[22] Filed: Oct. 13, 1976

[51] Int. Cl.[2] ..... A61G 7/04; A61G 9/00

[52] U.S. Cl. ..... 5/91; 4/112; 220/345

[58] Field of Search ..... 5/90, 91; 4/112, 113

[56] References Cited

U.S. PATENT DOCUMENTS

| | | | |
|---|---|---|---|
| 836,334 | 11/1906 | Newman | 4/112 |
| 1,319,024 | 10/1919 | Warfield | 220/345 |
| 2,532,083 | 11/1850 | Brenner | 220/345 |

FOREIGN PATENT DOCUMENTS

| | | | |
|---|---|---|---|
| 626,463 | 9/1927 | France | 4/112 |

*Primary Examiner*—Paul R. Gilliam
*Assistant Examiner*—Victor N. Sakran
*Attorney, Agent, or Firm*—Samuelson & Jacob

[57] ABSTRACT

A bed pan having an improved construction is provided which includes an elliptically shaped vessel having a continuous vessel forming sidewall, a bottom wall, and a top wall which is tilted upwardly from front to back. A recess is provided in the top wall through which waste material may be deposited into the vessel in the usual fashion by a user thereof. A downwardly turned lip in the top wall defines the recess therein. Underlying the mouth of the recess, a plate member is slidably mounted in the lip. A slot is provided in the rear portion of the sidewall and the plate member may be withdrawn therethrough, and access may then be had to the vessel interior.

3 Claims, 3 Drawing Figures

BED PAN

BACKGROUND OF THE INVENTION

The present invention relates generally to improvements in bed pan constructions, and more particularly to an improved bed pan having a slidable cover for confining noxious odors.

Hospital, and bed-ridden patients are usually provided with bed pans to comfort themselves. Heretofore, the patient had to tolerate noxious odors escaping from the bed pan until it was disposed of by an attendant.

Accordingly, the instant invention provides means for containing the noxious odors generated by waste material, until the bed pan can be cleansed thereof.

SUMMARY OF THE INVENTION

Generally speaking, in accordance with the invention, a bed pan having an improved construction is provided which includes an elliptically shaped vessel having a continuous vessel forming sidewall, a bottom wall, and a top wall which is tilted upwardly from front to back. A recess is provided in the top wall through which waste material may be deposited into the vessel in the usual fashion by a user thereof. A downwardly turned lip in the top wall defines the recess therein. Underlying the mouth of the recess, a plate member is slidably mounted in the lip. A slot is provided in the rear portion of the sidewall and the plate member may be withdrawn therethrough, and access may then be had to the vessel interior.

Accordingly, it is an object of the invention to provide an improved construction for a bed pan.

Another object of the invention is to provide a novel bed pan which substantially constrains the dispersal of noxious odors generated from waste material deposited therein.

A further object of the invention is to provide a bed pan having a cover thereon slidably underfitting the recess therein.

Still other objects and advantages of the invention will in part be obvious and will in part be apparent from the specification.

The invention accordingly comprises the features of construction, combinations of elements, and arrangement of parts which will be exemplified in the constructions hereinafter set forth, and scope of the invention will be indicated in the claims.

BRIEF DESCRIPTION OF THE DRAWING

For a fuller understanding of the invention, reference is had to the following description taken in commection with the accompanying drawing, in which.

DETAILED DESCRIPTION OF THE INVENTION

Figure 1:
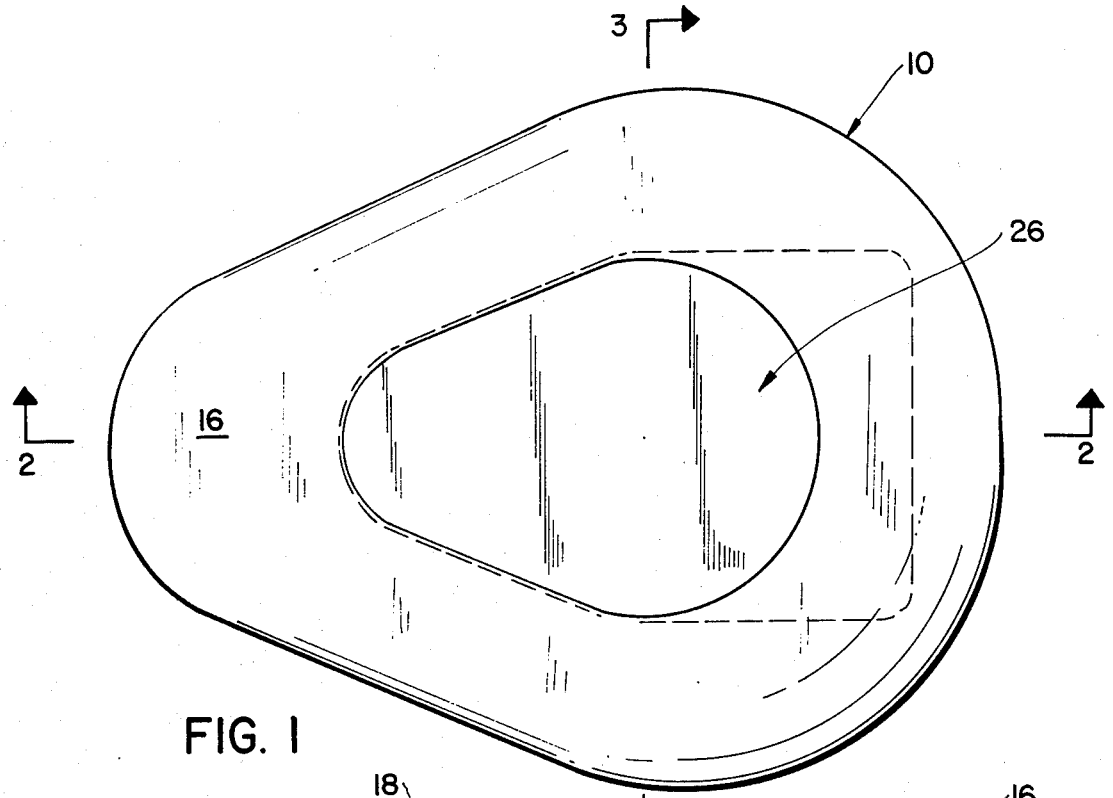
FIG. 1 is a top plan view of the improved bed pan constructed according to the instant invention.
Figure 2:
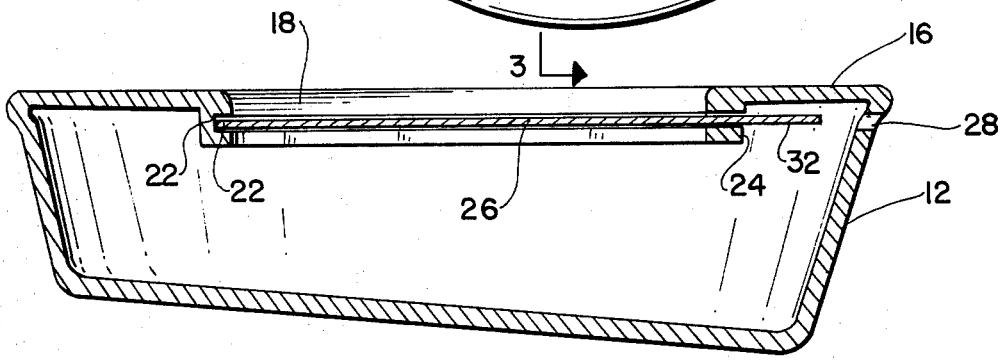
FIG. 2 is a sectional view of the embodiment seen in FIG. 1 taken along line 2—2 thereof.
Figure 3:
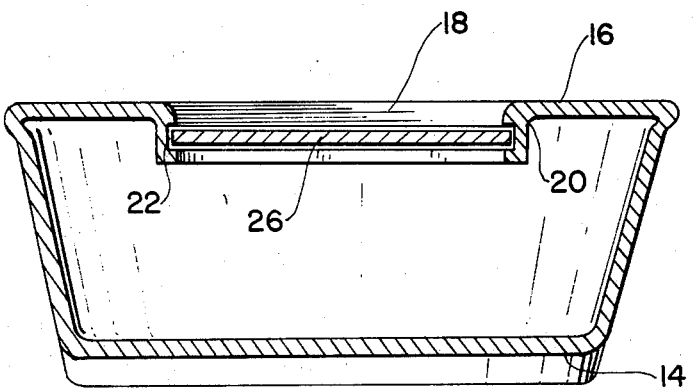
FIG. 3 is a sectional view of the embodiment seen in FIG. 1 taken along line 3—3 thereof.

Referring now to the drawing, the bed pan generally numbered 10 includes a vessel forming sidewall 12 which is continuous, a bottom wall 14, and a top wall 16 tilted upwardly from front to back. A recess 18 is formed in the top wall 16 through which waste material may be deposited in the usual manner. A continuous lip 20 depending downwardly from top wall 16 defines recess 18 and has a gusset 22 therein and a slot 24 arranged to cooperate therewith, as best seen in FIGS. 2 and 3 in which a cover plate 26 is slidably mounted.

Registered with the slot 24 in lip 20 is a slot 28 formed in sidewall 12. As seen in FIG. 2, cover plate 26 normally underlies the mouth of recess 18 having a first end 30 supported in gusset 22, and a second end 32 supported in slot 24.

Use may be made of bed pan 10 by sliding cover plate 26 from gusset 22 through slot 24 into slot 28, until cover plate 26 extends externally from pan 10 and provides substantially complete access through recess 18. Waste material deposited in the bed pan 10 may be fully contained therein by slidably remounting cover plate 26 under recess 18. In this manner, waste material deposited in bed pan 10 may be substantially fully contained therein until bed pan is cleansed.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An improved bed pan comprising an elliptically shaped vessel including a continuous vessel forming sidewall, a bottom wall, and a top wall, said top wall having a recess therein through which waste material may be deposited into said vessel in the usual fashion by a user thereof, a downwardly turned lip in said top wall defining said recess therein, said lip being spaced from said sidewall so that said recess is spaced from said sidewall and said top wall extends between said recess and said sidewall, a plate member underlying said mouth of said recess, said plate member being slidably mounted in said lip, and means for slidably mounting said plate member in said lip of said vessel so as to permit reciprocable sliding movement thereof for opening and closing said recess.

2. The improved bed pan as claimed in claim 1, said means for slidably mounting said plate member in said lip comprising a gusset in said lip, and said lip having a slot therein, said slot being arranged to cooperate with said gusset, said plate member having a first end removably mountable in said gusset and a second end supportably mountable in said slot, said first end of said cover plate being removable from said gusset and said cover plate being slidable through said slot for access to the interior of said vessel.

3. The improved bed pan as claimed in claim 2, said sidewall of said vessel having a slot therein, said slot being in registration with said slot in said lip of said vessel, said cover plate being slidable through said slot in said sidewall to a position exterior of said vessel.

* * * * *